US005337041A

United States Patent [19]

Friedman

[11] Patent Number: 5,337,041

[45] Date of Patent: Aug. 9, 1994

[54] PERSONAL SAFETY GUARD SYSTEM FOR STRAY PERSON OR PET

[76] Inventor: Lorri Friedman, 51 Forest Ct., Yorktown Heights, N.Y. 10598

[21] Appl. No.: 128,054

[22] Filed: Sep. 28, 1993

Related U.S. Application Data

[63] Continuation of Ser. No. 868,631, Apr. 13, 1992, abandoned.

[51] Int. Cl.[5] ..... G08B 21/00

[52] U.S. Cl. ..... 340/573; 340/539; 340/572; 340/692; 340/825.36; 340/825.49

[58] Field of Search ..... 340/572, 539, 692, 825.36, 340/825.49, 573

[56] References Cited

U.S. PATENT DOCUMENTS

| | | | |
|---|---|---|---|
| 3,866,204 | 2/1975 | Barkley | 340/692 |
| 4,314,240 | 2/1982 | Schnug | 340/573 |
| 4,476,469 | 10/1984 | Lander | 340/539 |
| 4,531,115 | 7/1985 | Black et al. | 340/539 |
| 4,598,272 | 7/1986 | Cox | 340/573 |
| 4,777,478 | 10/1988 | Hirsch et al. | 340/573 |
| 4,804,943 | 2/1989 | Soleimani | 340/539 |
| 4,814,751 | 3/1989 | Hawkins et al. | 340/573 |
| 4,850,031 | 7/1989 | Allsop et al. | 455/49 |
| 4,888,580 | 12/1989 | Distel | 340/573 |
| 4,897,630 | 1/1990 | Nykerk | 340/692 |
| 4,899,135 | 2/1990 | Ghahariiran | 340/573 |
| 4,990,892 | 2/1991 | Guest et al. | 340/573 |
| 5,025,247 | 6/1991 | Banks | 340/573 |
| 5,126,733 | 6/1992 | Sagers et al. | 340/825.49 |

OTHER PUBLICATIONS

The Safety Zone –Product catalog p. 59 (Spring/Summer 1993).

"The Safety Zone"–product catalog, pp. 5 & 52 (Winter 1991/1992).

"Build a Miniature Tracking Transmitter", V. Vollono, Popular Electronics, Jun. 1992, at p. 29, et seq.

Service Merchandise flyer, Jan. 1992, Wireless Musical Door Chime, item 3750DMG, p. 24.

Tandy–Radio Shack catalog 1992, Wireless Door Chime/Remote Pager, item 63–871, p. 124.

*Primary Examiner*—Glen R. Swann, III

*Attorney, Agent, or Firm*—Leo Zucker

[57] ABSTRACT

A personal safety guard system enables a guardian or caretaker of a person or pet to transmit an alarm condition signal from a hand-held unit carried by the guardian. When the alarm condition signal is received by a portable alarm unit adapted to be worn by the person or pet under the guardian's supervision, the alarm unit operates to alert the wearer that its guardian is looking for them, and to alert others nearby that the wearer is in need of assistance by producing a number of different alarm indicators. The alarm indicators produced by the portable alarm unit include an intelligible voice message such as "Help, I'm lost" which is alternately sounded with a loud alarm sound, and flashing strobe lights. These alarm indicators, together with a confirmation signal transmitted from the alarm unit to the guardian's unit, enable the guardian to track and find their charge.

18 Claims, 4 Drawing Sheets

TO RECEIVER PART (FIG.11)
TO TRANSMITTER PART (FIG.12)
TRANSMIT LATCH
S
R
FROM 216
FROM 218
200
202
204
206
207

TUNED FM RECEIVER
DET. OUT
AMP.
THRESHOLD
THRESHOLD
ALARM SELECTOR
LAMP DRIVE
SPEECH CIRCUIT
AMP.
TO XMIT LATCH S
TO XMIT LATCH R
FROM 202
208
210
212
214
216
218
220
222
223
224
226
64
66
68
70
82
85

TONE CODE SOURCE
BUFFER
AM EXCITER
AMP.
250
252
254
256
258
260
86a
86b

PERSONAL SAFETY GUARD SYSTEM FOR STRAY PERSON OR PET

This application is a continuation of application No. 07/868,631, filed Apr. 13, 1992, now abandoned.

BACKGROUND OF THE INVENTION

1. Field of the Invention

The present invention relates generally to radio frequency (RF) controlled alarm systems, and particularly to a remote controlled alarm system for assisting in the recovery of a stray person or pet by a guardian.

2. Discussion of the Known Art

We hear all too often about the tragic loss of children who are abducted during just those few moments while a parent or guardian's attention was diverted in a crowded department store, amusement park or shopping mall. Even though the abducted child may be near enough to its parent to call for help, or may be led past others who could be of help to reunite the child with its parent, the child may understandably be afraid to call for help for fear of being harmed by the abductor.

Certain services have been made available to the public as an aid in locating and recovering lost children. Advertising post cards are widely distributed through the U.S. Mail having a merchant's advertisement on one side of the card and photographs of one or more missing children with vital statistics and an "800" phone number printed on the other side, in case the recipient recognizes the lost child and wants to report the child's whereabouts.

Community programs have been introduced through the public elementary schools. For example, a local police department may send personnel to a school over the weekend with finger printing kits. The community is invited to have their children's fingerprints taken and the parents are given the fingerprints to take home for safe keeping. Such a program, sometimes called "Kinder Prints", is viewed as a means for protection against child abduction but in fact serves only to provide a positive means of child identification after an abduction takes place. It is of course preferable to take precautions before an abduction may occur and try to negate the possibility that an abduction will occur in the first instance.

Simple mechanical arrangements are also known by which a young child can be kept within a certain distance of a parent or guardian. A tether or child "leash" arrangement by which an adult holds one end of a long strap connected at its other end to a harness worn by the child, is an example of a known device for ensuring that a child does not stray far and get into trouble without the parent's knowledge.

Various monitoring systems are also known which use RF transmitters and receivers for enabling a parent to monitor the whereabouts of a child without the need for a mechanical connecting device. For example, U.S. Pat. No. 4,899,135 (Feb. 6, 1990) shows a child monitoring device comprised of a transmitting unit carried by the child, and a receiving unit carried by the child's guardian. The purpose of the device is to alert the guardian once the child strays beyond a certain distance, is abducted or falls into water. The child's unit is carried in a holster and emits a constant signal which is received and detected by the guardian's unit. A loss of the received signal at the guardian's unit initiates an audible warning signal. At such time, closing a switch on the guardian's unit causes a signal from the latter to energize an audio tone transmitter in the child's unit.

The monitoring system of the '135 patent has certain disadvantages. First, the guardian's unit will emit a sonic warning signal only when the child strays beyond a certain distance at which a threshold receiving circuit in the unit senses that the constant signal from the child's unit has fallen below a certain signal strength. Since most parents would not want a child monitoring device to sound an alarm if the child is only two or three feet away playing within view, the threshold circuit in the guardian's unit would likely be set to cause an alarm only if the child wanders more than, say, 100 feet. But a parent or guardian would want an alarm to sound if the child is suddenly no longer in view even though he or she may be hiding only a few feet away. For example, in a department store setting with much merchandise on the floor, a child need not stray very far distance-wise so as to be no longer in view of its parent. Once the parent realizes the child is "missing", he or she may begin to shout the child's name. The child, upon hearing its parents initial shouts usually feels that its parents are angry, and will hide on purpose nearby (behind a clothes rack is common). A parent who has experienced this situation and the accompanying fright and anxiety will know that every minute a child is apparently missing seems like an eternity. Moreover, the transmission of a constant, uninterrupted RF monitoring signal from the child's unit may not be permitted under the applicable rules of the Federal Communications Commission as discussed later below.

U.S. Pat. No. 4,777,478 (Oct. 11, 1988) describes apparatus for monitoring persons in which a periodic signal is transmitted from a monitored unit (B) to a monitoring unit (C) until certain threshold conditions are exceeded. Like the arrangement of the '135 patent, the apparatus of the '478 patent is a monitoring system relying basically on the receipt by monitoring unit C of a signal transmitted from the monitored unit B, the latter being worn by a person whose whereabouts are of interest to the one holding the monitoring unit C. In the apparatus of the '478 patent, if the signal received by monitoring unit C falls below a certain threshold value, the unit then sends a signal to monitored unit B causing the latter to radiate a continuous RF signal. No audible or visual alarm is produced at the site of the monitored unit B, however.

U.S. Pat. Nos. 4,314,240 (Feb. 2, 1982) and 4,850,031 (Jul. 18, 1989) relate to devices for locating avalanche victims and also depend on a signal transmitted from a unit held by the victim to a receiver unit carried by a rescuer.

A child protector device for warning a parent that a stationary child is being abducted by sounding an alarm, is disclosed in U.S. Pat. No. 4,888,580 (Dec. 19, 1989). Basically, the device comprises a housing that contains a battery power supply, an alarm buzzer, and a magnetic switch. The housing may be hidden in a stuffed animal placed next to the child. An outside string is connected between a magnet and a strap that encircles the child's ankle. As long as the magnet is held in place on the housing, the magnetic switch is kept open and the buzzer alarm remains silent. If the child is moved by a would-be abductor so as to cause the string to pull the magnet away from the housing, the magnetic switch closes and the alarm sounds.

A remotely controlled alarm system for a stolen briefcase is known from U.S. Pat. No. 4,804,943. There, a briefcase is provided with a receiver and a siren alarm. If the briefcase is stolen, the owner operates a transmitter which signals the receiver inside the briefcase. The siren then sounds and the briefcase drops away from its handle to be retrieved by the owner, according to the patent.

Any RF based alarm system must of course comply with the applicable rules and regulations imposed by the Federal Communications Commission (FCC). Consumer devices such as garage door openers that emit radio signals periodically are permitted without a license being necessary for the operator of the device. Pertinent rules and regulations are set out by the FCC at 47 C.F.R. §§ 15.1, et seq. Part 15 and all other relevant sections of the FCC rules and regulations are fully incorporated by reference herein.

Specifically, 47 C.F.R. § 15.231 allows for periodic operation of a manually operated transmitter or intentional radiator in the frequency band of 40.66–40.70 MHz and above 70 MHz, provided specified field strengths and transmission time periods are adhered to. This section also encourages the use of recognition codes for identifying a receiver or sensor that is to be activated. 47 C.F.R. § 15.205 and §15.209 place further restrictions on the transmitter signal frequency and signal strength. In any event, it is contemplated that an alarm signal transmitter such as the one disclosed below and capable of sending a detectable signal of sufficient strength up to a range of about one-quarter mile, can be constructed with a suitable antenna (see 47 C.F.R. § 15.203) in compliance with the relevant FCC rules and regulations.

SUMMARY OF THE INVENTION

An object of the present invention is to overcome the above and other disadvantages in the known child monitoring systems.

Another object of the invention is to enable a person having care or custody of another person or a pet, upon discovering that the person or pet is missing, to emit a signal that can be received by a receiver unit carried by the person or pet wherein the receiver unit triggers an alarm on the person or pet.

A further object of the invention is to provide a receiver unit that can be carried by a person or pet under the care of another, which unit responds to a radio signal transmitted by the caretaker in a manner so as to (1) allow the person or pet to be tracked or found, (2) alert others in the vicinity of the person or pet to stop them from wandering further, (3) alert the person or pet that their caretaker is looking for them, and (4) prevent abductions.

Another object of the invention is to provide a personal safety guard system for a stray person or pet which system will aid a parent, guardian or caretaker of a person or pet in finding the whereabouts of their charge as soon as the caretaker realizes that their charge is either out of view or does not respond to the caretaker's voice calls.

Yet another object of the invention is to provide a remote controlled alarm system in which a receiver unit carried by a child under the care of another, includes high intensity light elements and loud sounding alarm transducers for drawing the attention of others when triggered remotely by the caretaker.

Another object of the invention is to provide a personal safety guard system for a stray person or pet in which a receiver unit worn by the person or pet conveys an intelligible voice message to alert others nearby that the wearer of the receiver unit requires assistance.

A further object of the invention is to provide a personal safety guard system for a stray person or pet, in which a continuous RF monitoring signal need not be radiated from one unit to another under ordinary conditions.

According to the invention, an personal safety guard system for signaling a condition in which a person or a pet has gone astray, comprises guardian control means adapted to be carried by a guardian having control over the person or pet, including alarm signal means for transmitting an alarm condition signal over a certain range in response to an alarm command entered by the guardian. Portable alarm means adapted to be worn by the person or pet includes receiver means for detecting the alarm condition signal, and speech circuit means for emitting an intelligible voice message in response to the alarm condition signal wherein the voice message conveys the fact that the wearer of the portable alarm means requires assistance.

For a better understanding of the present invention, together with other and further objects, reference is made to the following description taken in conjunction with the accompanying drawing, and the scope of the invention will be pointed out in the appended claims.

BRIEF DESCRIPTION OF THE DRAWING

In the Drawing:

FIGS. 7–9 are schematic block diagrams of parts of the guardian's unit of FIG. 1, wherein;

FIG. 7 shows a battery power supply and switch arrangement,

FIG. 8 shows a receiver part of the guardian's unit, and

FIG. 9 shows a transmitter part of the guardian's unit;

FIGS. 10–12 are schematic block diagrams of parts of the alarm unit of FIG. 4, wherein FIG. 10 shows a battery power supply and switch arrangement, FIG. 11 shows a receiver/alarm part of the alarm unit, and FIG. 12 shows a transmitter part of the alarm unit.

DETAILED DESCRIPTION OF THE INVENTION

Figure 1:
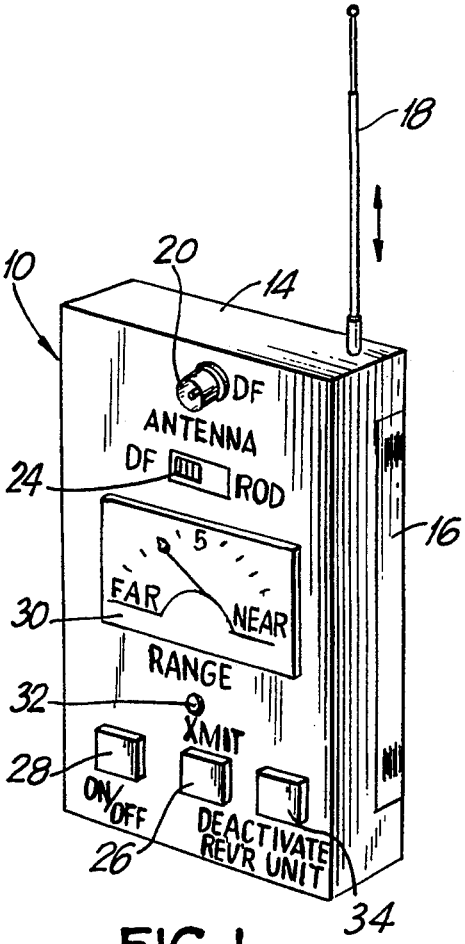
FIG. 1 is a perspective view of a guardian's transmitter unit as seen from the front, according to the invention.

FIG. 1 is a perspective view of a hand-held guardian's transmitter unit 10 according to the invention.

Figure 2:
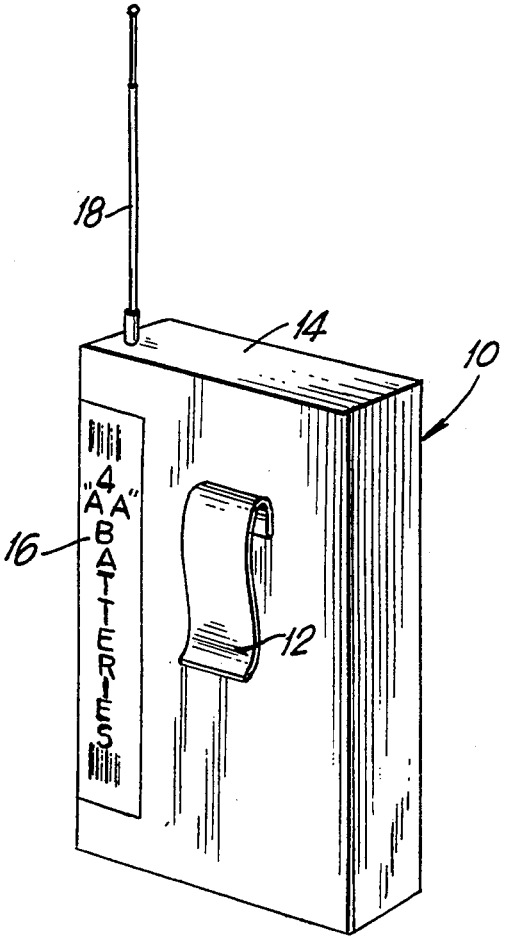
FIG. 2 is a perspective view of the transmitter unit in FIG. 1 as seen from the back of the unit.

Unit 10 is constructed so as to be easily carried by a parent or guardian in a pocket, purse or briefcase. As shown in FIG. 2, the unit 10 has a spring clip on its back surface to assist in holding the unit in one's pocket, or on a belt or waistband.

Transmitter unit 10 includes a housing 14 having a generally rectangular solid shape and is made of sturdy plastics and/or metallic materials of the kind ordinarily used to construct housings or cases for portable consumer radio devices. A detachable battery compartment cover 16 snaps in place to cover a set of batteries contained within the unit 10 for purposes of allowing the batteries to be replaced from time to time.

A telescoping rod-type antenna 18 projects from a corner of the top of the housing 14. Antenna 18 is capable of being retracted within the housing 14 when in a collapsed position, and of extending to a length suitable to enable the unit 10 to transmit an alarm condition signal over a desired range as explained further below.

The front face or panel of the unit 10 provides the user or guardian with the following features.

A "DF" or direction finding antenna connector jack 20 enables the user to connect a direction finding loop type antenna 22 (see FIG. 3) to the unit 10 as an aid in tracking or locating a missing person or pet as explained below. An antenna switch 24 allows the user to switch between a direction finding (DF) mode in which the DF antenna 22 is connected to the jack 20, and an alarm signal transmit mode of operation in which the rod antenna 18 is extended for purposes of radiating a periodic alarm condition signal over a certain range in response to an alarm command entered via a transmit (XMIT) push button switch 26.

A latching type ON/OFF push button switch 28 allows the user to switch the battery power supply for the unit 10 on and off. A range meter 30 provides an indication of the relative distance between a guardian and a person or pet for whom the guardian is responsible. A light emitting diode (LED) pilot lamp 32 signals the charge condition of the battery power supply whenever the transmit button 26 is activated.

A deactivate button 34 serves to enable the user to deactivate an alarm unit 50 (FIG. 4) after the alarm unit is triggered by the alarm condition signal radiated by the guardian's transmitter unit 10.

As shown in FIG. 2, the battery compartment cover 16 may have indicia on its surface for identifying the type of battery or batteries necessary to power the guardian's unit 10. Although the illustrated embodiment indicates the use of 4 "AA" batteries, it is possible that other kinds of batteries including rechargeable types which afford greater power capacity can be utilized. If rechargeable batteries are used, provision can be made, for example, for the bottom surface of the housing 14 to have a pair of exposed battery charging terminals to enable the unit 10 to be mounted on a conventional battery charger unit, thus making is unnecessary to provide an easily removable battery compartment cover.

Figure 3:
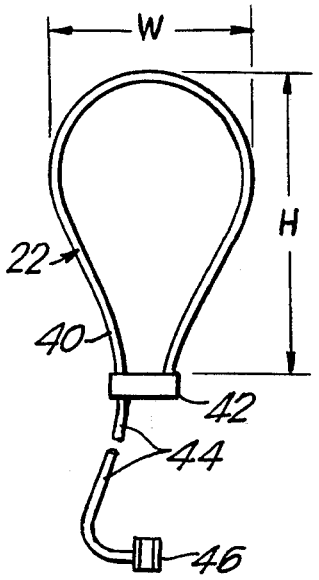
FIG. 3 shows a direction finding loop antenna that can be used with the guardian's unit of FIG. 1.

FIG. 3 shows a direction finding (DF) loop antenna 22 for use with the guardian's unit 10 in FIG. 1.

Antenna 22 is dimensioned and arranged to be worn about the neck of the user of the unit 10 when the unit is in a direction finding mode of operation, i.e., the switch 24 is placed in the DF position. Antenna 22 is comprised of a loop part 40 of a width (W) and a height (H) such that the part 40 can be easily placed over an adult user's head to rest on the shoulders and lie in a substantially vertical plane. A matching transformer 42 at the bottom of the loop part 40 is situated at about waist level when the loop part 40 is hung about the neck. Typical dimensions are about 10 inches width W and about 14–18 inches height H. The loop part 40 includes one or more turns of a wire conductor the opposite ends of which are matched via the transformer 42 at the operating frequency to a shielded coaxial feed line 44 which terminates with a coaxial connector 46. The connector 46 is of a type which mates with the DF connector 20 on the panel of the transmitter unit 10 (see FIG. 1). The wire conductor within the loop part 40 is preferably covered with a protective, flexible insulative material that will wear comfortably when placed over the user's neck and shoulders.

Figure 4:
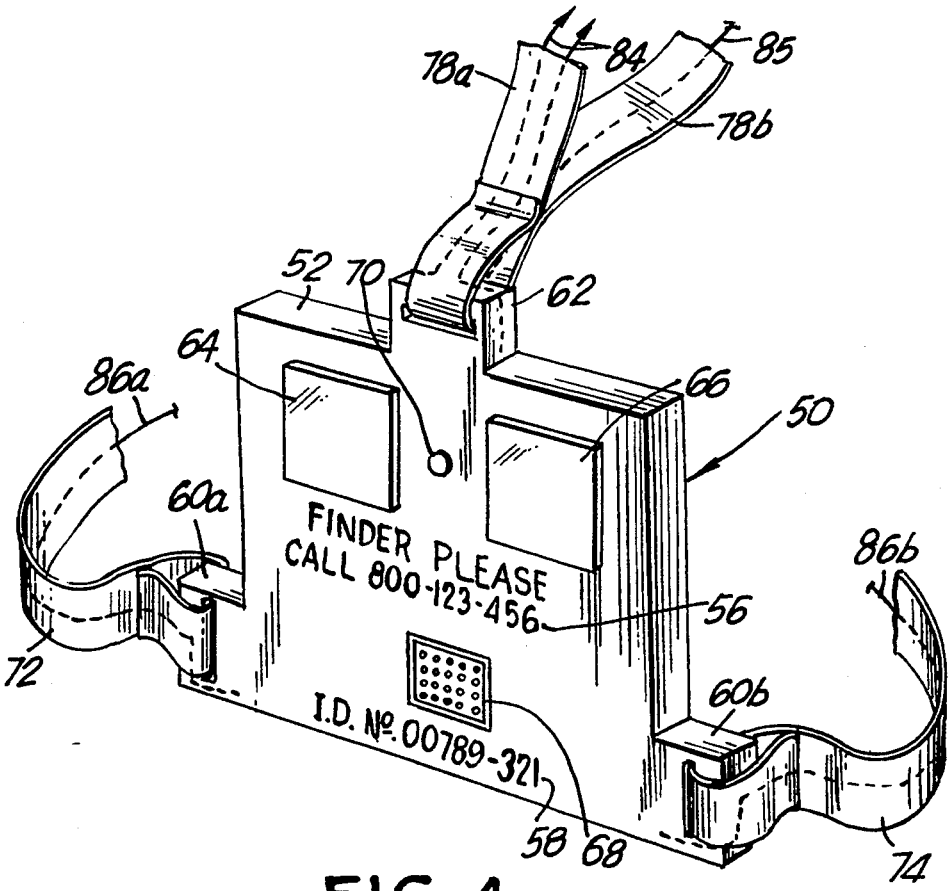
FIG. 4 is a front perspective view of a child or adult alarm unit, according to the invention.

FIG. 4 is a view of a child or pet alarm unit 50 according to the invention. The unit 50 shown and described herein is adapted to be worn by a young child or toddler who is capable of walking or running on their own, and who might be likely to stray away from a parent or guardian for some time before realizing that they are lost or that they require assistance.

Figure 5:
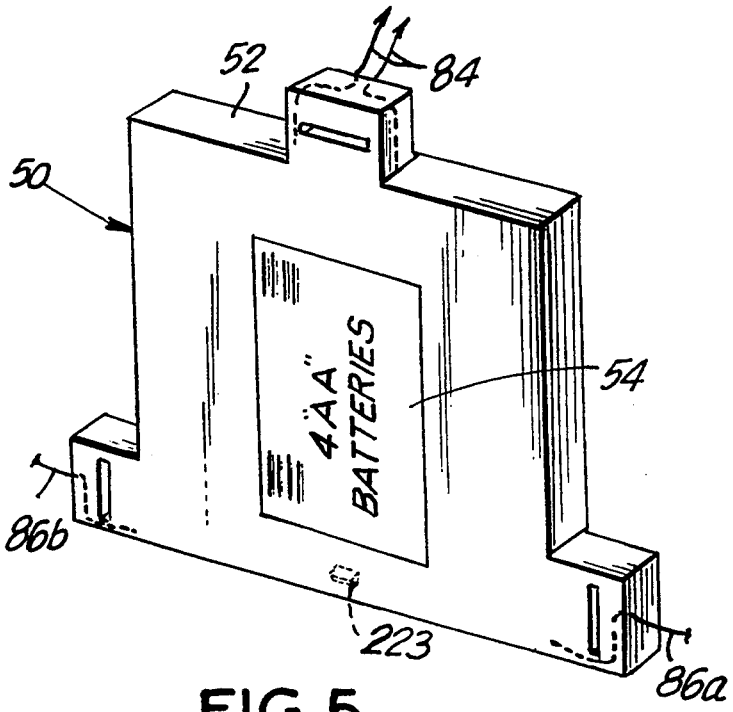
FIG. 5 is a rear perspective view of the alarm unit in FIG. 4.

Alarm unit 50 includes a housing 52 of durable sturdy material. The housing 52 preferably is water tight and shock resistant so as to withstand exposure to the elements while protecting the various components contained inside the housing 52. As shown in FIG. 5, a battery compartment cover 54 has indicia on its surface for identifying the type of battery or batteries necessary to power the alarm unit 50. Although the illustrated embodiment indicates the use of four AA batteries, it is preferred that rechargeable batteries which have relatively greater energy delivery capacity be used. A pair of exposed battery charging terminals (not shown) can be provided on the bottom surface of the housing 52, to enable the alarm unit 50 to be inserted in a conventional battery charger. Thus, the removable cover 54 can be eliminated and the alarm unit housing 52 can be completely sealed to avoid tampering with internal components by unauthorized persons. For example, once activated as explained below, it is preferred that the alarm unit 50 remain in an activated state and be incapable of being shut down such as by opening the unit and removing its batteries by an unauthorized person.

As shown in FIG. 4, the alarm unit 50 also has indicia on its face including a "finder" telephone number 56 and a user ID number 58. The indicia 56, 58 enable a person who finds a child wearing the unit 50 to find out, for example, the child's name, home address and telephone number should the child be unable to convey this information to the finder. That is, it is contemplated that purchasers of the present alarm system including the units 10, 50 will file or register their names, addresses and telephone numbers together with their ID number 58 with a common registry having an "800" phone number shown by the indicia 56. All indicia can be molded or otherwise securely fixed on an outside surface of the alarm unit housing 52.

The alarm unit housing 52 is preferably no more than about 4 to 5 inches square, and has a pair of belt loop ears **60*a*, 60*b* extending outwardly form the side walls of the housing 52, and a strap loop ear 62 projecting from the top surface of the housing 52. A pair of high intensity lamps 64, 66, a speaker 68, and a sound transducer element 70 are mounted as shown on the face of the alarm unit housing 52**.

Figure 6:
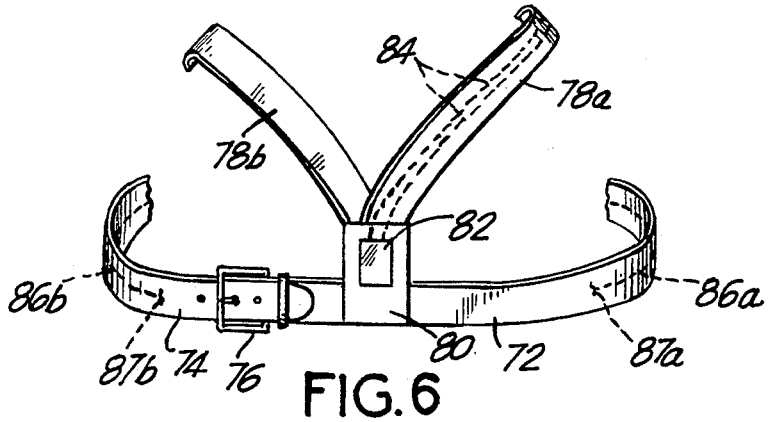
FIG. 6 is a view of a shoulder strap and belt arrangement for holding the alarm unit of FIG. 4 on a person, as seen from the back.

It is contemplated that the alarm unit 50 will be worn over a child's abdomen and held in place by way of flexible waist straps 72, 74 each of which is looped at one end through an associated ear **60*a*, 60*b* on the housing 52. FIG. 6 shows the waist straps 72, 74 as viewed from the back of a child wearing the alarm unit 50, the straps 72, 74 being joined to one another by a buckle arrangement 76**.

A pair of shoulder straps 78*a*, 78*b* loop at one end through the ear 62 atop the alarm unit housing 52, and are arranged to lie over a child's shoulders and rejoin one another near the waist straps 72, 74 at a generally rectangularly shaped panel 80. The panel 80, which can be made of a sturdy plastics material, has another high intensity lamp 82 mounted on its outer surface as shown. A pair of wire conductors 84 are embedded or otherwise fixed to the shoulder strap 78*a*, the conductors 84 connecting at one end to the lamp 82 and at the other end to circuitry within the alarm unit housing 52 (see FIG. 4).

A pair of antenna wires 86*a*, 86*b* are embedded in or otherwise fixed to the waist straps 72, 74, respectively, as shown in FIGS. 4 & 6. Wires 86*a*, 86*b* connect at one end to circuitry inside the alarm unit housing 52 after entering the belt loop ears 60*a*, 60*b* , and the wires have free ends 87*a*, 87*b* located so that the wires extend across the front of the wearer and slightly beyond toward the wearer's back.

Figure 7:
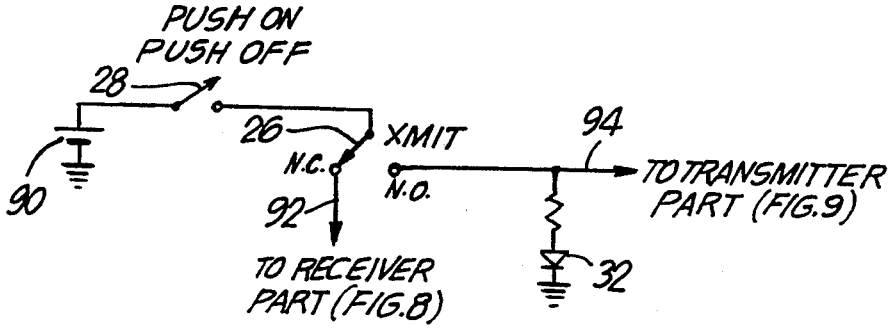

FIG. 7 is a schematic diagram of a battery power supply and switching arrangement within the guardian's transmitter unit 10 in FIG. 1.

Batteries 90 are provided within the unit housing 14 and are accessible via the battery compartment cover 16 seen in FIGS. 1 & 2. As mentioned, batteries 90 may also be of a rechargeable type sealed within the housing 14 and made connectable to an external charger unit via a pair of terminals (not shown) exposed on the surface of the unit housing 14.

One terminal of the battery 90 is grounded, and the other terminal is connected to one terminal of the ON/-OFF push button switch 28. The remaining terminal of the push button switch 28 is connected to a moving terminal of the transmit push button switch 26. A normally closed (NC) terminal of the switch 26 is connected to a main power supply bus 92 that connects to a receiver part of the unit 10, the receiver part being described below in connection with FIG. 8. A normally open (NO) terminal of the switch 26 connects through a resistor element to the battery charge LED 32, and to a transmitter power supply bus 94 which connects to a transmitter part of the unit 10. The transmitter part is described below in connection with FIG. 9.

Figure 8:
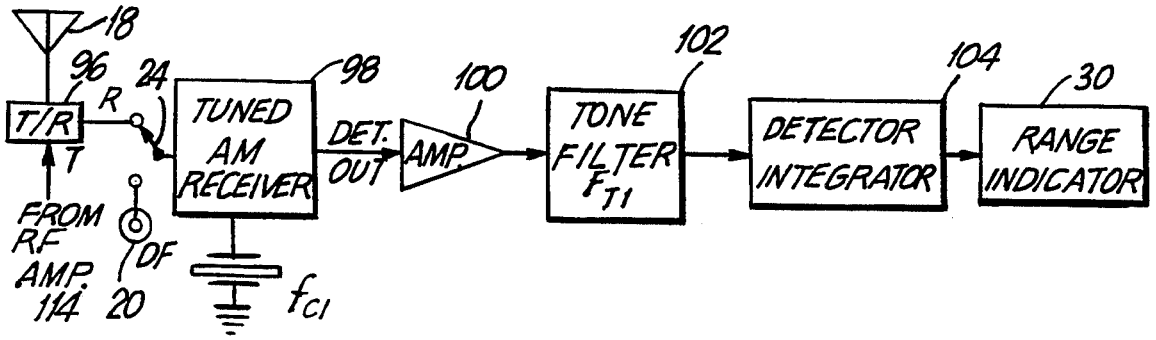

FIG. 8 is a diagram of the receiver part of the guardian's unit 10 in FIG. 1.

The telescoping rod antenna 18 is connected to an antenna terminal of a conventional transmit/receive antenna switch circuit 96, the purpose of which is to connect the antenna 18 to a receiver terminal R of circuit 96 during those times when no RF energy is applied to a transmit terminal T of circuit 96 from the transmitter part of the unit 10. Receiver terminal R is connected to a fixed contact of the antenna switch 24, the other fixed contact of which is connected to the DF connector jack 20. The moving contact of the switch 24 is connected to an input of a tuned AM receiver circuit 98 the frequency $f_{c1}$ of which is determined by a crystal element. Receiver circuit 98 may be provided in the form of one or more integrated circuit (IC) chips which are powered by the battery 90 via the supply bus 92 (FIG. 7). An output of the receiver circuit 98 in the form of detected audio frequency (AF) energy, is applied to an input of a conventional AF amplifier circuit 100. An output of the amplifier circuit 100 is applied to an input of a conventional tone filter circuit 102 having a sharp passband centered about a tone frequency of $F_{T1}$. An output of the tone filter circuit 102 is applied to an input of a detector/integrator circuit 104. Accordingly, any AF energy appearing at the detector output of the AM receiver circuit 98 and having a frequency $F_{T1}$ will be amplified and provided at the output of the circuit 104 to drive the range indicator 30. It will be understood that as the level of a detected radio frequency (RF) wave at $f_{c1}$ which is amplitude modulated at the tone $F_{T1}$ increases, the greater will be the deflection of the meter 30.

Figure 9:
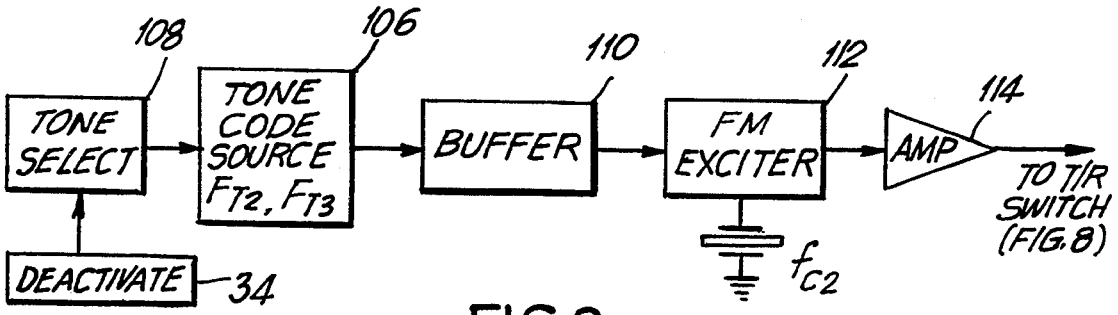

FIG. 9 shows a transmitter part of the guardian's unit 10 in FIG. 1.

A tone code source circuit 106 enables the user to determine which one of two AF tones will be modulated on a RF signal to be radiated from the unit 10 via the rod antenna 18. Circuit 106 is arranged in a stable AF oscillator configuration, and is responsive to a tone select circuit 108 which, in turn, is controlled by the deactivate button 34. For example, if the deactivate button 34 is in a normal (not depressed) state, tone select circuit 108 will set the tone code source circuit 106 to provide an output tone $F_{T2}$ at a certain frequency associated with the alarm unit 50. If the deactivate button 34 is depressed, however, the tone select circuit 108 will set tone code source circuit 106 to output a tone $F_{T3}$ at another frequency associated with the alarm unit 50.

Buffer circuit 110, which may also include an amplification stage, modulates a FM exciter circuit 112 at a frequency of either $F_{T2}$ or $F_{T3}$ depending on the state of deactivate switch 34. FM exciter circuit 112 may comprise one or more conventional ICs and operates at a crystal controlled frequency $f_{c2}$. An output from the FM exciter circuit 112 is input to RF amplifier stage 114. An output of stage 114 is connected to the T terminal of the T/R switch circuit 96 in FIG. 8.

Accordingly, when the transmit switch 26 is activated and battery power is applied to the transmitter power supply bus 94, the various circuits and stages of the transmitter part in FIG. 9 are energized via the power supply bus 94. RF energy at a frequency $f_{C2}$ and frequency modulated at either tone $F_{T2}$ or $F_{T3}$ is applied from the amplifier stage 114 through the T/R circuit 96 to be radiated from the rod antenna 18.

Figures 10, 11, 12:
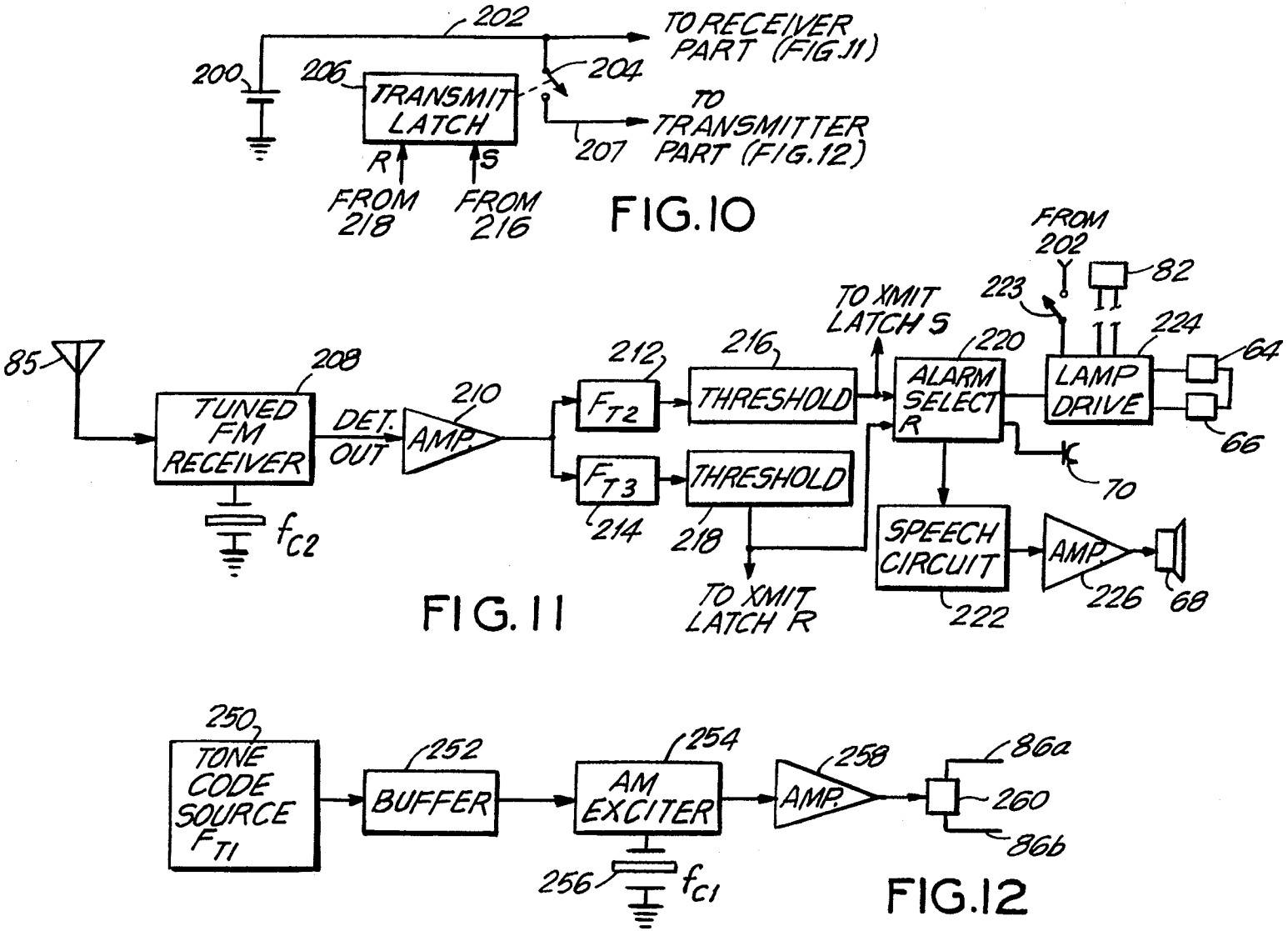

FIG. 10 shows a battery power supply and switch arrangement in the alarm unit 50 of FIG. 4.

An alarm unit battery 200 has one terminal grounded, and the other terminal is connected to a receiver power supply bus 202. The power supply bus 202 is connected to one terminal of a transmit switch 204 which remains in a normally open position until closed by a transmit switch latch circuit 206. Latch circuit 206 operates to close the switch 204 in response to a pulse or signal applied to a set (S) terminal, and to release the switch 204 to an open position in response to a pulse or signal applied to a reset (R) terminal of the circuit 206. When closed, the switch 204 applies a voltage from the battery 200 to a transmitter power supply bus 207.

FIG. 11 shows receiving and alarm circuitry included in the alarm unit 50 in FIG. 4.

The vertical antenna wire 85 which extends from the housing 52 of the alarm unit through the shoulder strap 78*b*, is connected internally of the housing 52 to an input of a tuned FM receiver circuit 208. Receiver circuit 208 may be in the form of one or more conventional ICs, and the receiving frequency $f_{C2}$ is determined, for example, by an external crystal element. The receiving frequency $f_{C2}$ of the receiver circuit 208 thus corresponds to the transmitting frequency of the transmitter part of the guardian's unit 10 described above in connection with FIG. 9.

Audio frequency tones detected on a signal received via the antenna wire 85 and FM receiver circuit 208, are output from the circuit 208 and applied to an input of an AF amplifier circuit 210. An output from the amplifier circuit 210 is applied to respective inputs of audio tone filter circuits 212, 214. Filter circuit 212 has a narrow passband centered at the audio frequency $F_{T2}$, and the filter circuit 214 has a narrow passband centered about the audio frequency $F_{T3}$. The tones $F_{T2}$ and $F_{T3}$ are sufficiently separated from one another, and the passbands of the filter circuits 212, 214 are sufficiently narrow to ensure that a detected tone at one of the passband frequencies corresponding to one of the circuits 212, 214, will be well out of the passband of the other one of the filter circuits. The tone frequencies are selected to correspond to those of the associated guardian's unit 10, and serve to prevent the alarm unit 50 from responding to other guardian units which may be operated within range.

An output from the filter circuit 212 is applied to an input of a threshold detection circuit 216, and an output from the filter circuit 214 is applied to an input of a threshold detection circuit 218. The purpose of the threshold detection circuits 216, 218 is to ensure that the alarm unit 50 does not respond to random noise or other spurious signals of relatively short duration not originating from the guardian's transmitter unit 10. The threshold detection circuits 216, 218 may therefore include conventional ICs and/or discrete components that, e.g., integrate the outputs from the filter circuits 212, 214 and compare the integrated outputs with a preset threshold level. Once the preset threshold level is exceeded, the circuits 216, 218 output a pulse or signal indicative of the transmission from the guardian's unit 10 of a signal modulated at a tone of $F_{T2}$ or $F_{T3}$. An output of the threshold circuit 216 is connected to the set S terminal of the transmit switch latch circuit 206 in FIG. 10. An output from the threshold detection circuit 218 is connected to the reset R terminal of the latch circuit 206. The output of the circuit 216 is also applied to an input of alarm select circuit 220. Alarm select circuit 220 is preset to drive, in a desired operating sequence, a speech circuit 222, the sound transducer element 70, and a lamp drive circuit 224. An output of the speech circuit 222 is applied to an input of speech amplifier 226 which, in turn, drives the speaker 68 on the alarm unit housing 52.

Once triggered by the output of circuit 216, the alarm select circuit 220 will continue to operate to cause the various alarm indicators 64, 66, 68, 70 and 82 to alert persons that the wearer of the unit 50 needs assistance. The circuit 220 can only be deactivated by way of a pulse or signal applied to a reset input terminal R. Lamp drive circuit 224 is configured to enable the lamps 64, 66, 82 to be connected directly to the battery 200 when switch 223 is manually closed. Switch 223 may be accessible on the bottom of the unit housing 52 (see FIG. 5). Circuit 224 may also include high voltage generating components for firing or strobing the lamps 66, 64, 82 on and off at a certain rate. Preferably, the lamps are high intensity strobe lights capable of rapid ON/OFF illumination.

FIG. 12 shows transmitter circuitry contained in the alarm unit 50 in FIG. 4. The circuitry in FIG. 12 is energized whenever the transmit switch 204 in FIG. 10 is latched closed by the latch circuit 206 in response to a set signal from the receiver threshold detection circuit 216 in FIG. 11. When the switch 204 is closed, voltage from the alarm unit battery 200 is applied to the transmitter power supply bus 207 which is connected to power the various circuits and stages shown in FIG. 12.

A tone code source circuit 250 supplies an AF tone signal at frequency $F_{T1}$ to an input of buffer circuit 252. An output of the buffer circuit 52 is applied to an input of AM exciter 254 which produces a RF signal having a carrier frequency $f_{C1}$ determined by a crystal element 256. The RF signal frequency $f_{C1}$ corresponds to the frequency of the tuned AM receiver circuit 98 in FIG. 8. The tone-modulated RF signal from AM exciter circuit 254 is input to RF amplifier stage 258. An output of the RF amplifier stage 258 is applied to RF matching transformer 260 which serves to transfer RF energy to the horizontal antenna wires **86*a*, 86*b* with maximum efficiency considering the operating frequency $f_{C1}$, and the length and orientation of the wires 86*a*, 86*b***.

Operation of the present alarm system including the guardian's transmitter unit 10 and the alarm unit 50, proceeds as follows.

To begin, the charge state of the batteries in the guardian's unit 10 is determined by turning the unit ON via the switch 28, and momentarily closing the transmit switch 26. If the battery charge LED 32 lights, the battery charge state is proper. Next, the charge state of the battery 200 in the alarm unit 50 is determined by momentarily closing battery check switch 223 and observing the brightness of the high intensity lamps 64, 66 and 82. Observing the lamps at substantially full brightness with the switch 223 closed indicates a sufficient battery charge for the alarm unit 50.

The alarm unit 50 is then placed on the body of a child or adult person whose whereabouts are of concern to a parent or guardian. The alarm unit housing is positioned centrally over the abdomen at or near waist level by adjusting the waist straps 72, 74 and shoulder straps **78*a*, 78*b* for a comfortable fit with the housing 52** at the desired position on the child's body.

The guardian then places his or her unit 10 in a pocket, purse, on a waist band or belt, or in some other accessory that the guardian is carrying at the time. If the guardian should become aware that his or her charge is no longer in view, the guardian simply withdraws the unit 10, extends the rod antenna 18, turns the unit on by pushing the switch 28, and closes the transmit switch 26 for several seconds while holding the unit 10 as high as possible. With the unit 10 turned on and the transmit switch closed, the transmitter part of the unit shown in FIG. 9 is energized via the bus 94 (FIG. 7), and the tone code source circuit 106 supplies an audio tone signal at $F_{T2}$ through the buffer circuit 110 to modulate FM exciter circuit 112. An amplified RF signal at carrier frequency $f_{C2}$ and frequency modulated at $F_{T2}$ is coupled to the rod antenna 18 through the T/R switch circuit 96 (FIG. 8). Depending on the power level of RF current in the rod antenna 18 and the size of antenna 18, the FM radio signal transmitted from the guardian's unit 10 will be detectable by the alarm unit 50 within a certain range of the guardian's unit 10, such range preferably being at least one-quarter mile.

The RF signal radiated from the rod antenna 18 will be detected by the vertical antenna wire 85 in the shoulder strap **78*b* of the alarm unit 50. The signal is detected by the FM receiver circuit 208 and the modulated audio tone at frequency $F_{T2}$ is amplified by the circuit 210 and bandpass filtered by the filter circuit 212 for threshold detection by the circuit 216. If the level of the received and detected tone signal exceeds the preset threshold, the alarm select circuit 220 is triggered and the transmit latch circuit 206 is set to close the transmit switch 204 and to energize the RF transmitter part of the alarm unit 50 (FIG. 12**).

When triggered, the alarm select circuit 220 operates to turn on the lamp drive circuit 224 and to cause the high intensity lamps 64, 66 & 82 to flash on and off at a preset rate, thus serving as a visual alarm indicator that the child or other person wearing the alarm unit 50 requires assistance. Alarm select circuit 220 is also configured to energize the sound transducer element 70 thus producing a loud, piercing alarm sound from the alarm unit 50, and to trigger the speech circuit 222 so as to produce a loud, preset voice signal, e.g., "Help, I'm lost", which signal is amplified at 226 and sounded by way of the speaker 68 in the alarm unit 50. Circuit 222 may comprise a conventional speech synthesizing IC programmed to produce speech signals corresponding to calls for help. The message may last for about 10 to 15 seconds, e.g., "Help, I'm lost. My parents are now looking for me and only they can shut this unit off."

It is preferred that the transducer element 70 be deenergized while the speech circuit 222 is being triggered, so that persons nearby will hear and understand the programmed voice message with little distraction. When the voice message ends, the element 70 immediately produces a loud, alerting tone lasting, say, 5–15 seconds and audible over as much as a quarter mile range. The loud sound from element 70 also serves to stun the wearer of the alarm unit and prevent them from wandering farther away. Also, the sound will aid the guardian in tracking and locating their charge.

Speech circuit 222 may be chosen from among the commercially available ICs, for example, the TSP50C4X family of speech synthesizers available from Texas Instruments (TI), Semiconductor Products, Dallas, Tex. Specifications and information on the selection and programming of these circuits is available from the TI Linear Products Design Manual for the mentioned synthesizer family, TI publication SPS5010 (1990), the contents of which are incorporated by reference herein.

Since the alarm unit transmitter part in FIG. 12 is now powered by the battery 200 connected to the supply bus 207 through the switch 204, the tone code source circuit 250 supplies an audio signal of frequency $F_{T1}$ through the buffer circuit 252 as a modulation signal for the AM exciter circuit 254. The modulated RF signal output from exciter 254 at the carrier frequency $f_{C1}$ is amplified at 258 and radiated from the horizontally oriented antenna wires **86*a*, 86*b* through the matching transformer 260. Accordingly, while the alarm unit 50 is providing visual and audible alarm indicators to alert others in the vicinity of the unit 50 that its wearer needs assistance, the unit 50 is radiating a RF confirmation signal for detection by the guardian's unit 10. This signal serves as an indication that the alarm unit 50 has been activated by the signal transmitted from the guardian's unit 10, and can be received via the rod antenna 18. Range meter 30 will then deflect in response to the confirmation signal which can also be received by (1) switching to the DF mode of operation via the antenna switch 24, and (2) connecting the direction finding antenna 22 of FIG. 3 to the unit 10 by way of the DF connector plug 46 which mates with the connector jack 20 on the unit 10**.

The loop DF antenna 22 will respond best when the plane of the loop is perpendicular to the signal being received from the alarm unit 50. Thus, the guardian or parent can wear the antenna 22 over their neck and shoulders and move in a direction in which the received signal increases in strength as shown on the range indicator meter 30. Specifically, referring the FIG. 8, signals detected by the antenna 22 and coupled to the AM receiver circuit 98 through the connector 20 and switch 24, are detected and amplified at 100 to be applied to the tone filter circuit 102. If the received and detected signal is modulated with the tone of frequency $F_{T1}$, the signal passes through filter circuit 102 to buffer/integrator circuit 104 which, in turn, drives the range indicator meter 30 to provide a relative indication of the distance between the alarm unit 50 and the guardian's unit 10, as well as the relative direction of the alarm unit.

Once the operator of the guardian's unit 10 locates the child or other person who is wearing the alarm unit 50, the alarm indicators of the unit 50 can all be deactivated by operating the deactivate switch 34 on the unit 10. As seen in FIG. 9, such operation causes the tone select circuit 108 to set the tone code source circuit 106 to produce a tone signal of frequency $F_{T3}$ which is supplied through buffer circuit 110 as a modulation signal for FM exciter circuit 112. Since the receiver part of the alarm unit 50 (see FIG. 11) is always in an ON state, the signal will be detected and applied to the threshold circuit 218 in FIG. 11 through the tone filter circuit 214. An output signal from the circuit 218 serves to reset the transmit latch 206 and, thus, open the transmit switch 204. At the same time, the alarm select circuit 220 is reset to de-energize the lamp circuit 224, the sound transducer element 70 and the speech circuit 222. It will be appreciated that by arranging the alarm unit 50 so that once activated it can be deactivated only by operating the guardian's unit 10, it becomes more difficult for a potential abductor to silence the alarm unit 50 and avoid the attention of others in the vicinity of the person or child who is wearing the unit.

While the foregoing description represents a preferred embodiment of the invention, it will be obvious to those skilled in the art that various changes and modifications may be made, without departing from the true spirit and scope of the invention.

For example, although the main thrust of the present alarm system as disclosed above is toward protecting young children, the alarm unit 50 may be adapted for elderly persons, pets, older children and adults. Different voice messages may be programmed in the speech circuit 222, and the alarm unit straps **72, 74, 78*a* and 78*b*** can be made adjustable for fitting persons or pets of various sizes.

An example of a preset voice message for an elderly person would be: "Help, I'm lost. Please wait with me and keep me from harm until my caretaker finds me and turns this unit off." Alternatively: "My caretaker has set off this alarm and is looking for me now. I may be confused but will not harm anyone. Please wait with me."

Older children can benefit from the present alarm system when their family is camping, hiking and the like. A typical scenario is one in which an older child goes alone to look for firewood and doesn't return on time. The child may have been hurt and become unable to call out for help, or it may become dark before he or she returns. A suitable voice message such as "Help, I'm lost" would suffice.

Provision can also be made to allow the speech circuit 222 to be user programmable so that the preset voice message or messages can be changed to suit the particular circumstances.

It may also be desirable to provide an emergency shut-off mechanism for the alarm unit 50 other than by way of signaling a "deactivate" RF signal from the guardian's transmitter unit 10. A key operated switch may therefore be provided, e.g., on the bottom of the alarm unit housing 52 which switch, when turned by use of a key possessed by authorized persons, would function to reset the transmit latch circuit 206 and reset the alarm select circuit 220 in the alarm unit 50. The switch can also operate to disconnect the alarm unit battery 200 from all circuits of the unit 50 until the unit is to be used again, thus prolonging battery life.

Although the effective range of the present alarm system may be up to about ¼ mile and thus be suitable for use in confined areas such as department stores, some shopping malls, supermarkets and the like, the operating range of the present system can be increased many times by way of repeater stations constructed at strategic locations in much larger settings such as amusement or theme parks. That is, RF repeater stations having antennas located high above ground may detect an alarm condition signal transmitted from a guardian's unit 10 at frequency $f_{c2}$ from up to ¼ mile away, and re-transmit the signal with the same modulated tone $F_{FT2}$ at a certain offset frequency. The tuned FM receiver circuit 208 in the alarm unit 50 would then be tuned to the offset frequency rather than $f_{c2}$, and thus respond to the stronger repeater output signal which would have an effective range of many miles. The transmitter part of the alarm unit 50 would then respond at frequency $f_{c1}$ and its signal would be received at one or more of the repeater stations within range of the unit 50. The child's approximate whereabouts would therefore by made known immediately notwithstanding the size of the park in which the child became separated from its parent or guardian.

Accordingly, the scope of the present invention is to be interpreted and construed in accordance with the following claims.

What I claim is:

1. A personal safety guard system for enhancing the safety of a person or pet under the care of a guardian in an unconfined environment, comprising:

a guardian unit including;

a first housing constructed to be carried by a guardian having care of a person or a pet, alarm signal means contained in said first housing, for producing an alarm condition signal at a certain radio frequency, first antenna means for radiating said alarm condition signal over a certain range when coupled to an output of said alarm signal means, and transmit switch means coupled to said alarm signal means, for operating said alarm signal means to produce the alarm condition signal in response to an alarm command entered by the guardian, and an alarm unit including;

a second housing constructed to be worn by said person or said pet, alarm receiver means contained in said second housing for detecting said alarm condition signal and for producing a corresponding alarm set signal, second antenna means coupled to an input of said alarm receiver means for responding to the alarm condition signal radiated from said first antenna means, speech circuit means for emitting a voice message prior to arrival of the guardian, including means for sounding said voice message to persons other than said guardian near the person or pet wearing the alarm unit, the voice message informing said persons that the person or pet is under a guardian's care and needs to be kept from potential harm until said guardian arrives, and alarm control means coupled to an output of said alarm receiver means and to said speech circuit means, for operating said speech circuit means to emit said voice message in response to said alarm set signal produced by the alarm receiver means;

wherein the alarm unit remains in a receive only mode of operation and the sounding means of said speech circuit means is inoperative prior to detection by the alarm receiver means of the alarm condition signal radiated from the first antenna means of the guardian unit.

2. A personal safety guard system according to claim 1, including sound transducer means coupled to said alarm control means for emitting a loud alarm sound, and said alarm control means including means for operating said speech circuit means and said sound transducer means in alternating relation so that those persons near the person or pet who is wearing the alarm unit will be able to hear and understand an entire voice message without distraction by said loud alarm sound.

3. A personal safety guard system according to claim 1, wherein said second housing is constructed to be worn prominently by said person or pet, and comprises at least one high intensity lamp on said second housing, and lamp drive means coupled to said alarm control means for energizing said high intensity lamp.

4. A personal safety guard system according to claim 1, wherein said alarm unit includes latch means responsive to said alarm set signal for maintaining the alarm unit in an alarm mode of operation after the alarm condition signal is detected by the alarm receiver means, whereby said alarm control means continues to operate after said alarm condition signal is no longer detected by said receiver means.

5. A personal safety guard system for enhancing the safety of a person or pet under the care of a guardian in an unconfined environment, comprising:

a guardian unit including;

a first housing constructed to be carried by a guardian having care of a person or a pet;

alarm signal means contained in said first housing, for producing an alarm condition signal at a certain radio frequency, first antenna means for radiating said alarm condition signal over a certain range when coupled to an output of said alarm signal means, transmit switch means coupled to said alarm signal means, for operating said alarm signal means to produce the alarm condition signal in response to an alarm command entered by the guardian, and confirmation signal receiver means contained in said first housing for detecting a confirmation signal at a certain radio frequency and for producing a corresponding indication, and an alarm unit including;

a second housing constructed to be worn by said person or said pet, a power supply contained in said housing, alarm receiver means contained in said second housing for detecting said alarm condition signal, and for producing a corresponding alarm set signal, second antenna means coupled to an input of said alarm receiver means for responding to the alarm condition signal radiated from said first antenna means, speech circuit means for emitting a voice message prior to arrival of the guardian, including means for sounding said voice message to persons other than said guardian near the person or pet wearing the alarm unit, the voice message informing said persons that the person or pet is under a guardian's care and needs to be kept from potential harm until said guardian arrives, alarm control means coupled to an output of said alarm receiver means and to said speech circuit means, for operating said speech circuit means to emit said voice message in response to said alarm set signal produced by the alarm receiver means, confirmation signal transmitting means for transmitting said confirmation signal to said guardian unit, and transmit start means coupled to said confirmation signal transmitting means and to said alarm receiver means, for energizing said confirmation signal transmitting means via said power supply in response to said alarm set signal;

wherein the alarm unit remains in a receive only mode of operation and the sounding means of said speech circuit means is inoperative prior to detection by the alarm receiver means of the alarm condition signal radiated from the first antenna means of the guardian unit, and the power supply of the alarm unit is connected to operate said confirmation signal transmitting means to enter a transmit mode of operation only after the alarm condition signal from the guardian unit is detected by the alarm receiver means of the alarm unit.

6. A personal safety guard system according to claim 5, wherein the transmit start means of said alarm unit comprises latch means responsive to said alarm set signal, for maintaining said confirmation signal transmitting means in said transmit mode of operation after said alarm condition signal is detected by said alarm receiver means.

7. A personal safety guard system accordingly to claim 6, wherein the alarm receiver means of said alarm unit comprises deactivate means responsive to a radio frequency deactivate signal from the guardian unit, for resetting said latch means to deactivate the confirmation signal transmitting means of the alarm unit.

8. A personal safety guard system according to claim 7, wherein the alarm signal means of said guardian unit includes means for producing said deactivate signal, and for coupling the deactivate signal to said first antenna means in response to a deactivate command entered by the guardian.

9. A personal safety guard system according to claim 5, including transmit/receive switch means associated with the first antenna means of said guardian unit, for connecting the first antenna means selectively with either an input of said confirmation signal receiver means or an output of said alarm signal means.

10. A personal safety guard system accordingly to claim 5, comprising direction finding antenna means for determining a direction from which said confirmation signal is radiated from the alarm unit, said guardian unit including antenna switch means for selectively switching an input of said confirmation signal receiver means between said first antenna means and said direction finding antenna means.

11. A personal safety guard system according to claim 5, wherein the sounding means of said alarm unit comprises speech circuit means for emitting a voice message.

12. A personal safety guard system according to claim 11, wherein the sounding means of said alarm unit comprises sound transducer means for emitting a loud alarm sound, and said alarm control means includes means for operating said speech circuit means and said sound transducer means in alternating relation so that those persons near the person or pet who is wearing the alarm unit will be able to hear and understand an entire voice message without distraction by the loud alarm sound.

13. A personal safety guard system according to claim 5, wherein said second housing is constructed to be worn prominently by said person or pet, and comprises at least one high intensity lamp on said second housing, and lamp drive means coupled to said alarm control means for energizing said high intensity lamp.

14. A personal safety guard system according to claim 5, wherein said alarm unit includes third antenna means coupled to an output of said confirmation signal transmitting means, for radiating said confirmation signal over said certain range to antenna means associated with said guardian unit.

15. A personal safety guard system for enhancing the safety of a person or pet under the care of a guardian in an unconfined environment, comprising:

a guardian unit including;

a first housing constructed to be carried by a guardian having care of a person or a pet, alarm signal means contained in said first housing, for producing an alarm condition signal at a certain radio frequency, first antenna means for radiating said alarm condition signals over a certain range when coupled to an output of said alarm signal means, and transmit switch means coupled to said alarm signal means, for operating said alarm signal means to produce the alarm condition signal in response to an alarm command entered by the guardian, an alarm unit including;

a second housing constructed to be worn by said person or said pet, alarm receiver means contained in said second housing for detecting said alarm condition signal, and for producing a corresponding alarm set signal, second antenna means coupled to an input of said alarm receiver means for responding to an alarm condition signal, speech circuit means for emitting a voice message prior to arrival of the guardian, including means for sounding said voice message to persons other than said guardian near the person or pet wearing the alarm unit, the voice message informing said persons that the person or pet is under a guardian's care and needs to be kept from potential harm until said guardian arrives, alarm control means coupled to an output of said alarm receiver means and to said speech circuit means, for operating said speech circuit means to emit said voice message in response to said alarm set signal produced by the alarm receiver means, locator signal transmitting means for transmitting a locator signal a certain distance from said alarm unit, and transmit start means coupled to said locator signal transmitting means and to said alarm receiver means, for energizing said locator signal transmitting means in response to said alarm set signal, and a repeater station located to respond to an alarm condition signal transmitted from the first antenna means of said guardian unit and to a locator signal transmitted from said alarm unit, said repeater station including;

means for detecting an alarm condition signal radiated from the first antenna means of said guardian unit;

means for repeating said alarm condition signal over a range greater than said certain range from the guardian unit, and means for detecting reception of a locator signal from an alarm unit associated with the guardian unit that transmitted said alarm condition signal, wherein the locator signal is transmitted from the alarm unit in response to an alarm condition signal that is repeated by the repeating means of said repeater station over a range greater than the range of said guardian unit.

16. The personal safety guard system of claim 15, wherein the sounding means of said alarm unit comprises sound transducer means for emitting a loud alarm sound, and said alarm control means including means for operating said speech circuit means and said transducer means in alternating relation so that those persons near the person or pet who is wearing the alarm unit will be able to hear and understand an entire voice message without distraction by the loud alarm sound.

17. The personal safety guard system of claim 15, wherein said second housing is constructed to be worn prominently by said person or pet, and comprises at least one high intensity lamp on said second housing, and lamp drive means coupled to said alarm means for energizing said high intensity lamp.

18. The personal safety guard system of claim 15, wherein the transmit start means of said alarm unit comprises latch means responsive to said alarm set signal, for maintaining said locator signal transmitter means in a transmit mode of operation after an alarm condition signal is detected by the alarm receiver means of the alarm unit.

* * * * *